United States Patent [19]

Blyth et al.

[11] Patent Number: 4,592,940

[45] Date of Patent: Jun. 3, 1986

[54] STAIN-RESISTANT NYLON CARPETS IMPREGNATED WITH CONDENSATION PRODUCT OF FORMALDEHYDE WITH MIXTURE OF DIPHENOLSULFONE AND PHENOLSULFONIC ACID

[75] Inventors: Randolph C. Blyth, Gulf Breeze; Pompelio A. Ucci, Pensacola, both of Fla.

[73] Assignee: Monsanto Company, St. Louis, Mo.

[21] Appl. No.: 768,302

[22] Filed: Aug. 22, 1985

Related U.S. Application Data

[63] Continuation-in-part of Ser. No. 562,371, Dec. 16, 1983, abandoned.

[51] Int. Cl.[4] ..... B32B 3/02

[52] U.S. Cl. ..... 428/96; 252/8.7; 252/8.75; 252/8.8; 427/430.1; 427/434.2; 427/434.6; 428/97

[58] Field of Search ..... 428/96, 97; 252/8.7, 252/8.8, 8.75; 427/430.1, 434.2, 434.6

[56] References Cited

U.S. PATENT DOCUMENTS

| | | | |
|---|---|---|---|
| 3,118,723 | 1/1964 | Harding | 8/4 |
| 3,178,309 | 4/1965 | Harding | 117/139.5 |
| 3,322,488 | 5/1967 | Freeman | 8/115.5 |
| 3,663,157 | 5/1972 | Gilgien et al. | 8/65 |
| 3,765,839 | 10/1973 | Mueller et al. | 8/65 |
| 3,849,162 | 11/1974 | Mueller et al. | 117/33.5 |
| 4,192,754 | 3/1980 | Marshall | 252/8.8 |
| 4,295,852 | 10/1981 | Walz et al. | 8/560 |
| 4,302,202 | 11/1981 | Sumner et al. | 8/455 |
| 4,317,736 | 3/1982 | Marshall | 252/8.75 |
| 4,325,890 | 4/1982 | Reitz et al. | 260/512 |

*Primary Examiner*—Marion C. McCamish
*Attorney, Agent, or Firm*—John W. Whisler

[57] ABSTRACT

Nylon carpets are rendered resistant to staining normally caused by artificial colorants such as Food, Drug and Cosmetic Red Dye No. 40 by immersing the carpets in a boiling aqueous solution of a selected phenol-formaldehyde condensation product at a pH of 4.5 or less. A particularly useful condensation product is that obtained by the condensation of formaldehyde with a mixture of diphenolsulfone and phenolsulfonic acid.

10 Claims, No Drawings

STAIN-RESISTANT NYLON CARPETS IMPREGNATED WITH CONDENSATION PRODUCT OF FORMALDEHYDE WITH MIXTURE OF DIPHENOLSULFONE AND PHENOLSULFONIC ACID

CROSS-REFERENCE TO RELATED APPLICATIONS

This application is a continuation-in-part of copending application Ser. No. 562,371, filed Dec. 16, 1983, and now abandoned.

BACKGROUND OF THE INVENTION

1. Field of the Invention

This invention relates to novel strain resistant nylon carpets and to a novel process for providing such carpets. As used herein, the term "nylon carpet" means carpet in which the yarn used in making the pile fabric thereof consists essentially of nylon yarn, the term "yarn" means a continuous strand of fibers and the term "fibers" includes fibers of extreme or indefinite length (i.e. filaments) and fibers of short length (i.e., staple).

The term "stain resistant" when used herein with reference to carpet means carpet having the ability to resist staining when subjected to Food, Drug and Cosmetic Red Dye No. 40 (herein after referred to as Red Dye 40) under the conditions set forth in the Stain Resistance Test given hereinafter. Briefly, the test involves subjecting a test sample of carpet to two standard washing cycles in a conventional washing machine and then immersing the sample in a solution containing Red Dye No. 40. If the carpet is not visibly stained by the dye under the test conditions, the carpet is stain resistant within the meaning of the term as used herein. The purpose of the test is to identify carpets having durable and lasting resistance to staining normally caused by Red Dye 40.

Red Dye No. 40 is an acid dye having the following structure:

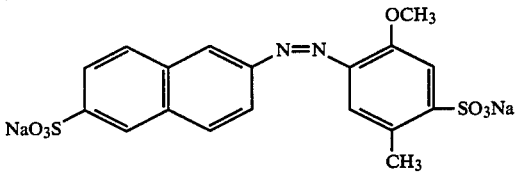

2. Description of the Prior Art

Nylon carpet is a popular floor covering for both residential and commercial applications. Such carpeting is relatively inexpensive and offers a desirable combination of qualities, such as aesthetics, comfort, safety, warmth and quietness. Also, it is available in a wide variety of attractive colors, patterns and textures. However, nylon carpet is permanently stained by most artificial colorants normally added to foods, beverages, medicines, cosmetic, etc., the most common of which is Red Dye No. 40.

It is a conventional practice to coat nylon carpet fibers with a fluorochemical to prevent wetting of the carpet surface and thus minimize contact between the carpet surface and foreign substance (e.g. soil). However, such an approach offers very little protection to the carpet in instances where the foreign substance is a substance such as Red Dye 40 unless, of course, the substance is immediately removed from the carpet before it has a chance to stain the carpet. Surveys of the carpet replacement market show that more carpets are replaced due to staining than due to wear. Therefore, there is a need in the art to develop stain resistant nylon carpet having the ability to retain its original appearance for an extended period of time.

SUMMARY OF THE INVENTION

The present invention provides stain resistant nylon carpet and a process for obtaining such carpet. The process comprises immersing a carpet having a pile made from nylon yarn in an aqueous solution of a polymeric condensation product consisting essentially of repeating units of the formula

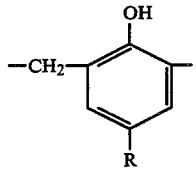

where R is the same or different in each unit and is hydrogen or a radical selected from the group consisting of —$SO_3X$,

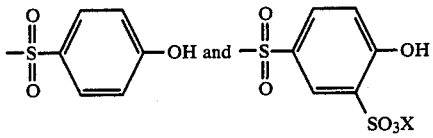

with the proviso that at least 40% of the total units contain an —$SO_3X$ radical and at least 40% of the total units contain the

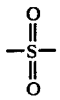

linkage, wherein X is H or a cation, e.g. $NH_3$, Na, K, etc., and the weight ratio of aqueous solution to nylon yarn, the pH and temperature of the solution and the amount of the condensation product in the solution are correlated to provide a carpet coated with a sufficient amount of the product to impart stain resistance thereto. Normally, a sufficient amount of the polymeric condensation product is an amount in excess of about 0.1% by weight, based on the weight of nylon fiber, for example, amounts ranging from 0.3% to 1.0% on weight of fiber. At concentrations above about 1.0% on weight of fiber the fibers become stiff and impart a harsh and undesirable hand to the carpet.

It has been discovered that carpet treated in accordance with the present invention can be sheared in a conventional manner (i.e., as the last step in the carpet making process) to provide a cut pile carpet in which the freshly exposed pipe fiber ends are stain resistant without further treatment. This is important since further treatment of the carpet after the shearing step were required to achieve stain resistance of the exposed ends, such treatment would add significantly to the overall cost of the carpet and, therefore, be undesirable.

PREFERRED EMBODIMENTS OF THE INVENTION

In practicing the process of the present invention the aqueous solution should be maintained at a pH no greater than about 4.5 and at a temperature at least about 95° C., otherwise, the carpet does not pick up sufficient condensation product to impart stain resistance thereto. Preferably, the aqueous solution is maintained at a pH of 4.5 at the boil. In order that the condensation product is transferred from the solution to the carpet within a reasonable time, the ratio of aqueous solution to carpet fiber should be within the range of 20:1 to 40:1. It has been discovered that in carrying out the process at a ratio of about 20:1 and with the solution at a pH of 4.5 and at the boil, about 40% to 50% of the condensation product is picked up by the immersed carpet in about 30 minutes. Accordingly, under these conditions the aqueous solution must contain 0.25 to 2.5%, based on the weight of carpet fiber, (a 100 to 150% excess) of the product in order to coat the carpet with a sufficient amount of the product (0.1 to 1.0% on weight of fiber) to impart stain resistance thereto. Of course, the exact amount of the excess required in a given instance will depend on the particular processing conditions selected and can be easily determined by routing experimentation.

Water-soluble condensation products useful in practicing the process of the present invention may be prepared by the condensation of formaldehyde with one or more phenols selected from the group consisting of (i) diphenolsulfone, (ii) diphenolsulfone sulfonic acid or salt thereof and (iii) phenolsulfonic acid or salt thereof, with the phenols being selected so that at least 40% of the phenols contain the

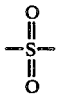

linkage and at least 40% contain a sulfonic acid radical of salt thereof. Representative salts of the sulfonic acids include the alkali metal salts, such as sodium and potassium, and the ammonium salt and may be obtained by neutralizing the sulfonic acid with a base such as sodium, potassium or ammonium hydroxide.

Condensation products prepared from monosulfonic acids have been found to impart better stain resistance to the carpet than corresponding products prepared from di- or trisulfonic acids and, therefore, are preferred with p-phenolsulfonic acid and 4,4-diphenolsulfone-2-sulfonic acid being particularly preferred. Representative condensation products include the product having repeating units of the formulas

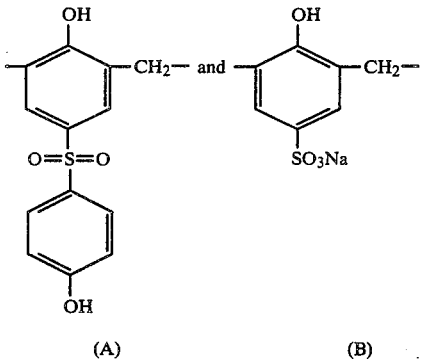

(A) (B)

where the product ratio of (A) to (B) is 60 to 40 and the product having repeating units of the formulas

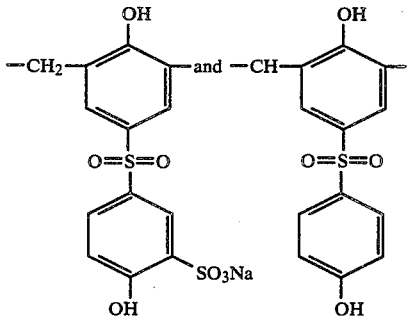

(C) (D)

where the ratio of units (C) to (D) is at least 8:1 and preferable as high as possible with products in which all of units are units (C) being preferred.

The molecular weight and the monosulfonate content of the water-soluble condensation product preferably is as high as possible, for example, a molecular weight ranging from 400 to 800 with a monosulfonate content of 100% or as near 100% as possible.

The water solubility of the condensation product is influenced by the type of terminal groups present in its structure, for example, hydrophylic groups such as $—CH_2OH$ and $—CH_2SO_3H$ render the product more water soluble than groups, such as methyl groups.

The condensation products may conveniently be prepared by methods known in the art, for example, by condensation of the phenols with formaldehyde in an acid or alkaline medium at elevated temperatures. In an acid medium, from 0.3 to 0.5 mole of formaldehyde is used for each mole of phenol and, in a basic medium, from 0.9 to 1.5 moles of formaldehyde is used for each mole of phenol. The basic condensation provides products having a greater proportion of terminal $—CH_2OH$ groups and, therefore, greater water-solubility.

According to one aspect of the invention the nylon carpet is treated during beck dyeing operations, by lowering the pH of the beck dye bath from its normal range of 6.5 to 8.0, to 4.5 or lower.

Any nylon carpet may be treated in accordance with the process of the present invention. Nylon carpets of major commercial importance are those having pile fibers shaped from nylon 66 which is polyhexamethylene adipamide and those shaped from nylon 6 which is polycaprolactam. Other nylons from which the pile fibers may be shaped include nylon 11 which is the polymer of 11-amino undecanoic acid, nylon 610 which is polyhexamethylene sebacamide; and copolymers of nylon 66 or nylon 6, for example, a nylon 66/6 copolymer or nylon 66/6TA copolymer where 6TA is hexamethylene terephthalamide.

STAIN RESISTANCE TEST

The following test procedure is used to identify stain resistant carpet.

A 5 cm×5 cm sample of carpet is subjected to two wash cycles in a heavy-duty Sears and Roebuck electric washing machine Model No. 111.7114802. Detergent (100–150 gms), sold by Lever Brothers Company under the tradename ALL ®, is used in both cycles with the second cycle being started immediately after completion of the first cycle. For each cycle the settings on the machine are as follows: the fabric setting is Cotton, Linen, Colored; the wash/rinse setting is Warm (48° C.) Wash/Cold Rinse; the water level setting is Low; and the wash cycle setting is 14 Minute Wash Cycle. (If desired, instead of using the washing machine and detergent specified, an equivalent washing machine and/or detergent may be used.) After the second cycle is completed, the sample is removed from the washing machine and immersed in an aqueous solution of FD&C Red Dye No. 40 in which the concentration of the dye is 0.054 gms/liter. The carpet sample is left immersed in the solution for one hour. The sample is then removed from the solution and washed with tap water. If the sample is not visibly stained by the dye, it is characterized as being stain resistant within the meaning of the expression as it is used herein.

The following example is given to further illustrate the invention.

EXAMPLE

In this example cut pile tufted carpets were prepared from polyamide fibers and treated in accordance with the process of the present invention. The treated carpets were then tested to evaluate their resistance to staining by various colorants present in common household substances.

A 310 filament, 60 denier per filament (dpf), undrawn nylon 66 yarn was prepared by conventional procedures. Fifty-four (54) such yarns were combined to form a tow having a total denier of about 1,000,000. The tow was drawn over rolls to provide nominal 18 dpf tow, crimped in a conventional stuffer box and cut into 7½ inch (19.05 cm) staple. The staple was carded, drafted and spun on a conventional ring spinning frame to provide a 2½ cotton count yarn having about 4.5 tpi (177 tpm) of twist in the Z-direction. Two of these yarns were plied on a conventional ring twister to provide a plied yarn having a net twist of 0 tpi in the Z-direction and 3 tpi (118 tpm) in the S-direction. The resulting plied yarn was then heatset. Two cut pile tufted carpets were made from the heatset plied staple yarn and dyed to a light gold color in a conventional beck dyeing operation in which the carpet was immersed in an aqueous dye bath contained within a vessel. The bath was maintained at a pH of 6.5 and at the boiling temperature of the bath (liquor). The weight ratio of liquor to carpet fiber was 20:1. Light gold was selected as being a color which contrasts well with most stains. The liquor was then drained from the dye vessel and replaced with a corresponding amount of water. A water-soluble product formed by the acid condensation of 4,4'-diphenolsulfone, p-phenolsulfonic acid and formaldehyde in which the mole ratio of sulfone to sulfonic acid is about 60:40 was added to the vessel and dissolved in the water in an amount sufficient to provide 0.4% by weight of condensation product on weight of carpet pile fabric. The resulting solution was adjusted to a pH of 4.5 by the addition of an appropriate amount of acetic acid thereof. The solution was then brought to the boil and one of the carpets was immersed (treated) therein for a period of 30 minutes.

The treated carpet (invention) and untreated carpet (control) were then sheared (i.e., defuzzed) and used in conducting the following tests.

TEST A

Five samples of the treated carpet were subjected to the Stain Resistance Test, described previously herein, except in this instance the washing machine was operated through five wash cycles, detergent being added at the beginning of each cycle. At the completion of each cycle one of the carpet samples was removed from the washing machine. For purposes of comparisons a sample of untreated carpet (control) was subjected to Red Dye 40 in accordance wtih the test. The results of the test are given below.

TABLE I

| Samples | Wash Cycles | Stained | Comments |
|---|---|---|---|
| Control | None | Yes | Bright Red |
| Treated | 1 | No | No Visible Stain |
| Treated | 2 | No | No Visible Stain |
| Treated | 3 | No | No Visible Stain |
| Treated | 4 | Yes | Slight Tint of Pink |
| Treated | 5 | Yes | Slight Tint of Pink |

The results of this test clearly illustrate the stain resistant characteristics of polyamide carpets treated in accordance with the present invention.

In a related experiment, a polyamide carpet was treated with the above mentioned water-soluble product in the manner described above except in this instance the pH of the bath was adjusted to 6.5. The treated carpet was then subjected to Test A. The results of the test showed the carpet to be visibly stained after only one wash cycle. This experiment demonstrates the importance of carrying out the treating of the carpet at a low pH.

TEST B

Samples of the treated and untreated (control) carpets were subjected to the common household liquid substances listed in the table below to determine the resistance of the samples to staining by colorants present in these substances. Each substance was applied to the carpet sample, rubbed into the carpet, left on the sample overnight and, finally, the next day the sample was washed to remove the substance, first with a dilute water solution of a commercial detergent and then with water.

TABLE II

| | Staining Results | |
|---|---|---|
| | Carpet Samples | |
| Substance | Invention | Control |
| Coffee/Cream/Sugar | Removed | Stained |
| Cola | Removed | Removed |
| Red Wine | Removed | Stained |
| Watercolor | Removed | Removed |
| Mustard w/Turmeric | Stained | Stained |
| Mustard w/out Turmeric | Removed | Removed |

TABLE II-continued

| Substance | Staining Results: Carpet Samples: Invention | Control |
|---|---|---|
| Soft Drink w/Red Dye 40* | Removed | Stained |

*soft drink is prepared by dissolving soft drink premix ingredients in a specified amount of water.

The results in the Table clearly show that carpet treated in accordance with the process of the invention has resistance to staining when compared to the corresponding untreated carpet.

TEST C

In test B, the substance which most severely and permanently stained the untreated carpet samples was the soft drink (cherry flavored) containing Red Dye 40 in a concentration of 0.054 gms/liter. A separate test was conducted to determine the effect of a massive spill of the soft drink on a sample of the treated carpet. In this test, one gallon (3785 ml) of the soft drink was poured onto an appropriate sized carpet sample from a gallon milk container, the container being held at a height of one meter above the face of the carpet sample. The soft drink was left on the carpet sample overnight. No steps were taken to clean the carpet or remove any of the soft drink until the next day. The next day the carpet sample was cleaned in the manner described above. Surprisingly, after being cleaned, no visual evidence of the soft drink (Red Dye 40) remained on the carpet sample.

TEST D

Fiber samples taken from the treated and untreated carpets were tested to determine the ability of the fibers to resist staining by the above soft drink. In these experiments, the optical density of a weighed amount of soft drink containing FD&C Red Dye No. 40 was measured on a Carey 15 Spectrophotometer using a ½ cm cell with the light absorption being measured at 520 millimicrons. (Light absorption is a measure of dye concentration of the drink.) The drink was prepared as before according to the instructions on the package containing the premix ingredients. The drink was prepared as before according to the instructions on the package containing the premix ingredients. The light absorption reading was recorded as $T_0$. The soft drink was put into a stoppered container with a sufficient amount of fiber sample to provide a weight ratio of drink to fiber of 40:1. The stoppered container of drink and fiber was then shaken on a motorized shaker for a period of two hours. The fiber was then removed from the container and the optical density of the drink was determined as before. The reading this time was recorded as $T_1$. (If the fiber sample did not resist staining, i.e., took up dye from the drink, the $T_1$ value was less than the $T_0$ value; on the other hand, if the fiber sample resisted staining, i.e., took up no dye, the $T_0$ and $T_1$ were the same.) In order to compare samples the test results were expressed as a change in light penetration, expressed as a percentage, calculated as follows:

$$\% = \frac{T_0 - T_1}{T_1} \times 100.$$

The lower the percentage, the more resistant the yarn was to staining. In these experiments, fiber samples taken from carpets treated in accordance with the process made of the present invention gave test values ranging from 0 to 1.0%, whereas fibers taken from untreated (control) carpets gave test values ranging from 30 to 35%.

What is claimed is:

1. A process for imparting stain resistance to a carpet having a pile made from nylon yarn, comprising immersing said carpet in an aqueous solution of a polymeric condensation product consisting essentially of repeating units of the formula

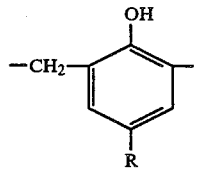

where R is the same or different in each unit and is hydrogen or a radical selected from the group consisting of —$SO_3X$,

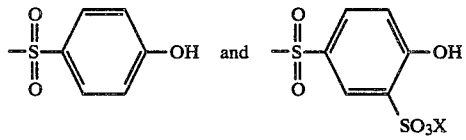

with the
proviso that at least 40% of the units contain an —$SO_3X$ radical and at least 40% of the units contain the

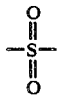

linkage, where X is H or a cation and the weight ratio of aqueous solution to nylon yarn, the pH and temperature of the solution and the amount of said condensation product in the solution are correlated to provide a carpet coated with a sufficient amount of the product to impart stain resistance to said carpet.

2. The process of claim 1 wherein the pH of the solution is no greater than 4.5.

3. The process of claim 1 wherein the aqueous solution is maintained at the boil.

4. The process of claim 1 wherein said weight ratio is in the range of 20:1 to 40:1.

5. The process of claim 1 wherein said carpet is coated with from 0.3% to 1.0% based on the weight of polyamide yarn.

6. The process of claim 1 wherein R in at least 40% of the units is

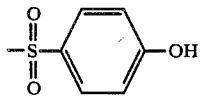

and in the remainder of the units is —$SO_3H$ or a salt thereof.

7. The process of claim 1 wherein R in at least 80% of the units is

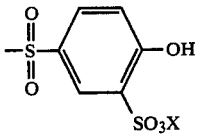
and in the remainder of the units R is
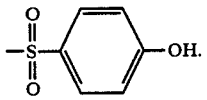
8. The process of claim 1 wherein said ratio is about 20:1.
9. A nylon carpet coated in accordance with the process of claim 1.
10. The carpet of claim 9 wherein said nylon is nylon 66 yarn.
* * * * *

UNITED STATES PATENT AND TRADEMARK OFFICE

CERTIFICATE OF CORRECTION

PATENT NO. : 4,592,940

DATED : June 3, 1986

INVENTOR(S) : Randolph C. Blyth et al.

It is certified that error appears in the above-identified patent and that said Letters Patent is hereby corrected as shown below:

Column 5, line 25, after "of" insert -- cherry flavored soft drink premix containing --.

Signed and Sealed this

Thirtieth Day of December, 1986

*Attest:*

DONALD J. QUIGG

*Attesting Officer*

*Commissioner of Patents and Trademarks*